US006877474B2

(12) United States Patent
Radel

(10) Patent No.: US 6,877,474 B2
(45) Date of Patent: Apr. 12, 2005

(54) MIXTURE LUBRICATION OF A FOUR-STROKE INTERNAL COMBUSTION ENGINE

(75) Inventor: Harry Radel, Geesthacht (DE)

(73) Assignee: Dolmar GmbH, Hamburg (DE)

( * ) Notice: Subject to any disclaimer, the term of this patent is extended or adjusted under 35 U.S.C. 154(b) by 0 days.

(21) Appl. No.: 10/446,551

(22) Filed: May 27, 2003

(65) Prior Publication Data

US 2003/0233993 A1 Dec. 25, 2003

(30) Foreign Application Priority Data

Jun. 24, 2002 (DE) ..... 202 09 794 U

(51) Int. Cl.[7] ..... F02B 63/02
(52) U.S. Cl. ..... 123/196 R; 123/196 M
(58) Field of Search ..... 123/196 R, 196 CP, 123/196 M, 1 A

(56) References Cited

U.S. PATENT DOCUMENTS 4,122,818 A * 10/1978 Hattori ..... 123/196 AB
4,771,745 A * 9/1988 Nakamura et al. ..... 123/196 R
4,947,812 A * 8/1990 Inoue et al. ..... 123/193.2
4,969,434 A * 11/1990 Nakagawa ..... 123/196 M
5,123,385 A * 6/1992 Sado et al. ..... 123/193.5
5,176,116 A * 1/1993 Imagawa et al. ..... 123/196 W
5,960,764 A * 10/1999 Araki ..... 123/196 R
5,975,042 A * 11/1999 Aizawa et al. ..... 123/196 M
6,000,373 A * 12/1999 Woodhouse ..... 123/196 R
6,145,484 A * 11/2000 Funakoshi et al. ..... 123/73 AD
6,152,098 A * 11/2000 Becker et al. ..... 123/196 R

FOREIGN PATENT DOCUMENTS

DE 198 60 391 A1 6/2000
DE 19860391 A1 * 6/2000 ..... F02B/63/02

* cited by examiner

*Primary Examiner*—Noah P. Kamen
*Assistant Examiner*—Jason Benton
(74) *Attorney, Agent, or Firm*—Kelly Lowry & Kelley, LLP

(57) ABSTRACT

In order to provide a four-stroke internal combustion engine (100) having a control chamber (16) and a cylinder (14), provided with at least one intake valve (12) and at least one exhaust valve, which has a crankshaft chamber (22) formed by a crankcase (26), in which a connecting rod (24) connected to the reciprocating piston (18) drives a mounted crankshaft (28), having an ignition device and having a supply device (30) for an air-fuel mixture, which is connected on one side via a connection line (32) to the control chamber (16) and on the other side in the flow direction (54) of the air-fuel mixture to the piston chamber (20) via a throttle device (34) positioned in a mixture intake port (36) and via a mixture supply line (38), which is connected via a non-return valve (40*a*) to the crankshaft chamber (22), and having an overflow channel (44) between the crankshaft chamber (22) and control chamber (16), in which a camshaft (46) is positioned for controlling the intake and exhaust valves (10, 12), which allows reliable lubrication of all parts, particularly during idling, and stable idling operation simply and without regulatory outlay, it is suggested that the mixture supply line (38) may be closed if necessary during idling operation via an activatable switching valve (10).

13 Claims, 3 Drawing Sheets

MIXTURE LUBRICATION OF A FOUR-STROKE INTERNAL COMBUSTION ENGINE

Figure 1:
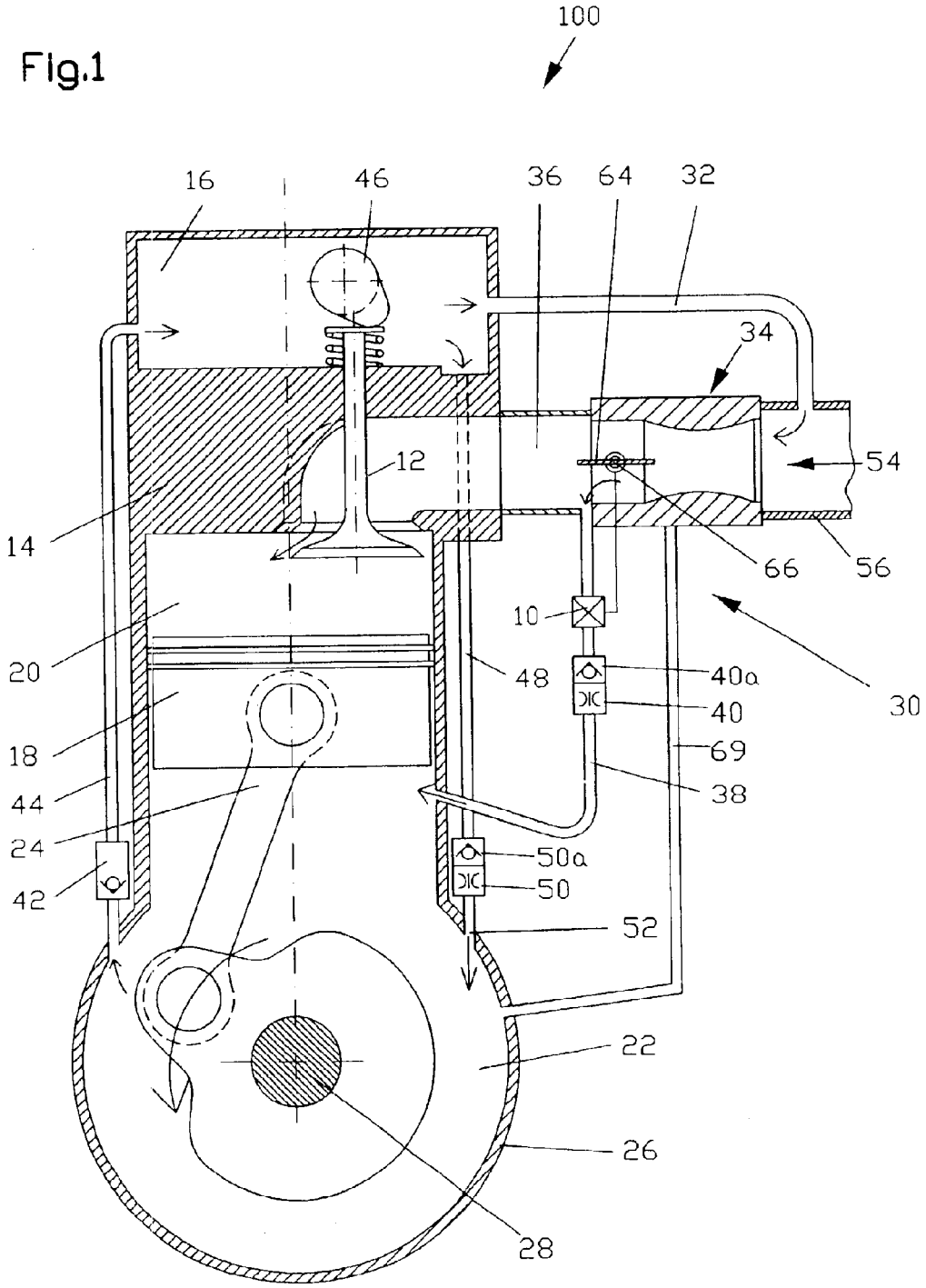

The present invention relates to a four-stroke internal combustion engine having the features cited in the preamble of Claim 1.

Four-stroke internal combustion engines of the type according to the species are known. They operate in such a way that after the intake stroke, during which the intake valve is open, the compression stroke occurs, and after ignition, in a working stroke, the combustion gases are ejected through the exhaust valve during an exhaust stroke.

A four-stroke internal combustion engine, in which the load changes are to be optimized, is described in German Patent 30 22 901. For this type of four-stroke internal combustion engines, the necessary parts are not lubricated by oil poured into the radiator housing, but rather they operate like a two-stroke internal combustion engine in regard to their lubrication. The oil used for lubrication is thus already added to the air-fuel mixture.

In the following, references to the air-fuel mixture always refer to an air-fuel mixture having an oil component necessary for lubrication.

In addition, a non-return valve for the intake of the air-fuel mixture into the crankcase via a mixture supply line is known from German Patent 30 22 901. Furthermore, a non-return valve in a supply line, via which the air-fuel mixture reaches a pre-compression chamber, is known. The entire air-fuel mixture is transported through the engine and then conveyed directly from the pre-compression chamber via, an intake valve into the combustion chamber. The air-fuel mixture is heated in this way and the engine thus loses usable power. German Patent 34 38 031 also discloses a mixture-lubricated engine. As described in German Published Application 30 22 901, the induction of the air-fuel mixture occurs solely via the crankcase, the pre-compressed mixture also being stored in the pre-compression chamber, from which it is inducted during the intake stroke. German Patent 34 38 031 discloses that the pre-compression chamber is connected via a connection line to the intake port of a mixture formation device, the intake port leading to an intake opening having an intake valve of the cylinder. The connection line has a throttle valve in this case, which is positioned between the pre-compression chamber and the intake port. In addition, a line which supplies an air-fuel mixture, which is also connected to the intake port and in which a non-return valve is positioned, discharges into the crankcase. As the piston goes upward, air-fuel mixture is inducted into the crankcase.

A further line connects the crankcase to the pre-compression chamber. Through this construction, it is ensured during the strokes of the known four-stroke internal combustion engine that the parts to be lubricated are more reliably lubricated not only through induction of air-fuel mixture from the pre-compression chamber, but rather also from the mixture formation device via the intake port.

However, it is disadvantageous in this case that no valve is positioned in the line between the crankcase and the pre-compression chamber, so that the pre-compression capability of the crankcase may not be used completely. Poor acceleration of the internal combustion engine due to the lower pre-compression capability is connected with this.

In addition, due to the throttle valve positioned in the connection line between the pre-compression chamber and the intake port, it is disadvantageous that the setting of the throttle valve is subject to strong oscillations, above all in the idling range and/or in the lower speed range, due to pressure oscillations in the region of the connection line, which results in unstable idling of the internal combustion engine. In addition, irregular fuel supply and therefore irregular lubricant supply may occur in the cylinder of the four-stroke internal combustion engine due to the throttle valve. During idling, fuel-air mixture is removed from the intake port in an uncontrolled way. The mixture quantity necessary for stable idling is changed this way. Unsteady idling results from this.

A connection line between a crankcase and a valve chamber is disclosed in U.S. Pat. No. 6,145,484, similarly to German Patent 34 38 031. This connection line is alternatively equipped with a valve.

Furthermore, as in German Patent 34 38 031, a connection line is positioned between the crankcase and the valve chamber, the air-fuel mixture present in the valve chamber and the lubricant oil contained therein being supplied out of the valve chamber between the air filter and the carburetor to the line otherwise used as the mixture supply into the crankcase, but only when the control valve positioned on the intake valve is open together with the intake valve. The mixture supply line also has a non-return valve before the entrance into the crankcase.

The related art according to the publications cited above has the disadvantage that for idling, i.e., during low supply of air-fuel mixture, sufficient lubrication is not ensured through the existing circuits.

The present invention is therefore based on the object of providing a four-stroke internal combustion engine of the type according to the species, which allows reliable lubrication of all parts, particularly during idling, and stable idling operation, easily and without regulatory expense.

This object is achieved according to the present invention by a four-stroke internal combustion engine having the features cited in Claim 1.

In this way, because a four-stroke internal combustion engine having a cylinder, provided with an intake valve and outlet valve, which has a crankshaft chamber 22 formed by a crankcase 26, in which a connecting rod connected to the reciprocating piston drives a mounted crankshaft, having an ignition device and having a supply device for an air-fuel mixture, which is connected on one side via a connection line to the control chamber and on the other side, in the flow direction of the air-fuel mixture, via a throttle device positioned in the mixture intake port, to the piston chamber, and via a mixture supply line, which is connected via a return valve to the crankshaft chamber and to an overflow channel between the crankshaft chamber and the control chamber, in which a camshaft is positioned for controlling the intake and outlet valves, the mixture supply line able to be closed during idling, stable idling and simultaneously reliable lubrication may be achieved. Preferably, a shutoff valve for the mixture supply line is provided in this line, which may be activated by the throttle valve and/or the throttle valve shaft when the throttle valve shaft is opened, i.e., the mixture supply line opens upon a change of the setting of the throttle valve out of the idle setting. According to other possible embodiments according to the present invention, the shutoff valve may be actuated and/or activated through further means, the gas button for controlling the internal combustion engine, a servo valve for determining the partial vacuum in the carburetor housing, a sensor for detecting one of the relevant operating states of the internal combustion engine, or the centrifugal clutch being usable in this case. All of these control means share the feature that they open the switching valve and therefore release the mixture supply line if an idle state different from the preset defined idle state is reached. This may be performed purely mechanically by actuation of the gas switch, the increasing partial vacuum in the carburetor housing and/or in the intake port upon a change of the throttle valve ankle, determination of a changed operating state of the internal combustion engine, such as an increased speed, or the movement of the clutch drum carried along by the centrifugal clutch.

A preferred embodiment of the present invention provides that the control chamber is connected to the crankshaft chamber through a return line, through which lubrication of the parts of the crankshaft chamber, piston chamber, and control chamber and all supplying and exhausting lines is possible through the return line, as the connection between the control chamber and the crankshaft chamber.

A further preferred embodiment of the present invention provides that a non-return valve is positioned in the return line.

In a further preferred embodiment of the present invention, the return line discharges into the crankcase of the crankshaft chamber, without the reciprocating piston closing an opening in the crankcase during its stroke movements.

The arrangement for the overflow channel is similar to that for the return line.

Furthermore, the present invention discloses that the return line may be assigned different operating positions, in that multiple return lines are positioned instead of one return line.

An array of advantages result from the preferred embodiment of the present invention cited. Because the mixture supply line is blocked by the throttle device during idling, stable idling is ensured. The lubricant remaining in the cylinder is sufficient for safe idling, particularly because the internal return line according to the present invention, from the control chamber into the crankshaft chamber, forms an internal lubricant circuit, through which the danger of insufficient lubrication may be prevented.

It is especially advantageous in a further embodiment of the present invention that the non-return valves of the return line and/or the mixture supply line may be dispensed with if the cross-section of the overflow channel is larger than the cross-sections of the mixture supply line and/or the return line. In this way, reduction of the material outlay and simpler distribution of the air-fuel mixture are achievable.

Further preferred embodiments of the present invention result from the remaining features, cited in the subclaims.

Thus, it is provided according to an advantageous refinement that the fuel pump, implemented as a membrane pump, is connected to the crankshaft chamber via a line implemented as a pulse line. By separating the crankshaft chamber from the remaining contents of the engine, effective excess pressure and partial vacuum are generated in the crankshaft chamber through the pistons going up and down, which is advantageously very suitable for driving the fuel pump, implemented as a membrane pump, for which a corresponding connection line is provided. The membrane pump may be positioned externally to the internal combustion engine. It is also possible to implement it integrated in other components. The core idea of the present invention in this case is that a connection line is provided between the crankcase, i.e., the crankshaft chamber, and the membrane pump.

The present invention is described in greater detail in the following in an exemplary embodiment on the basis of the associated drawing.

Figure 2:
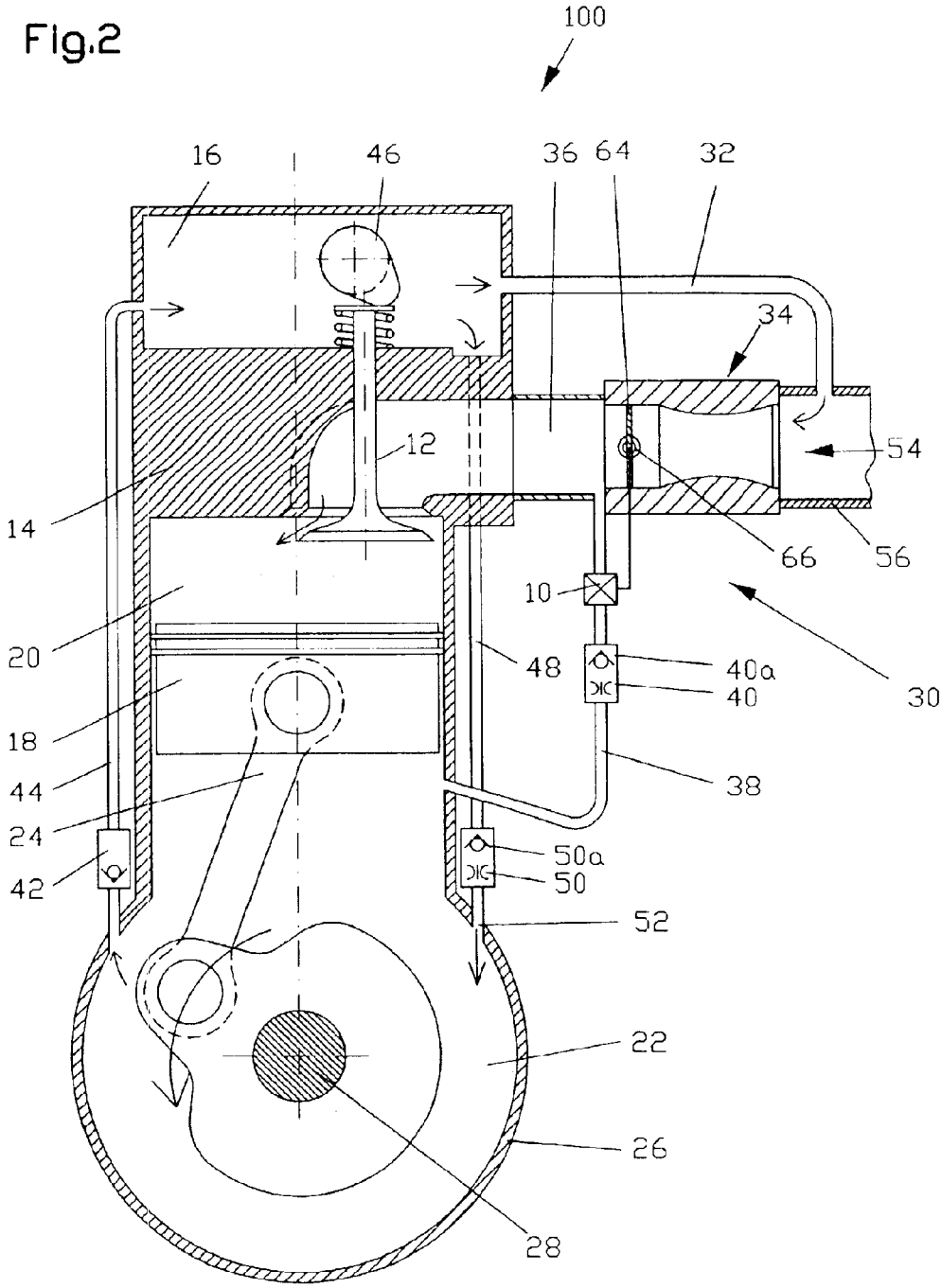
Figure 3:
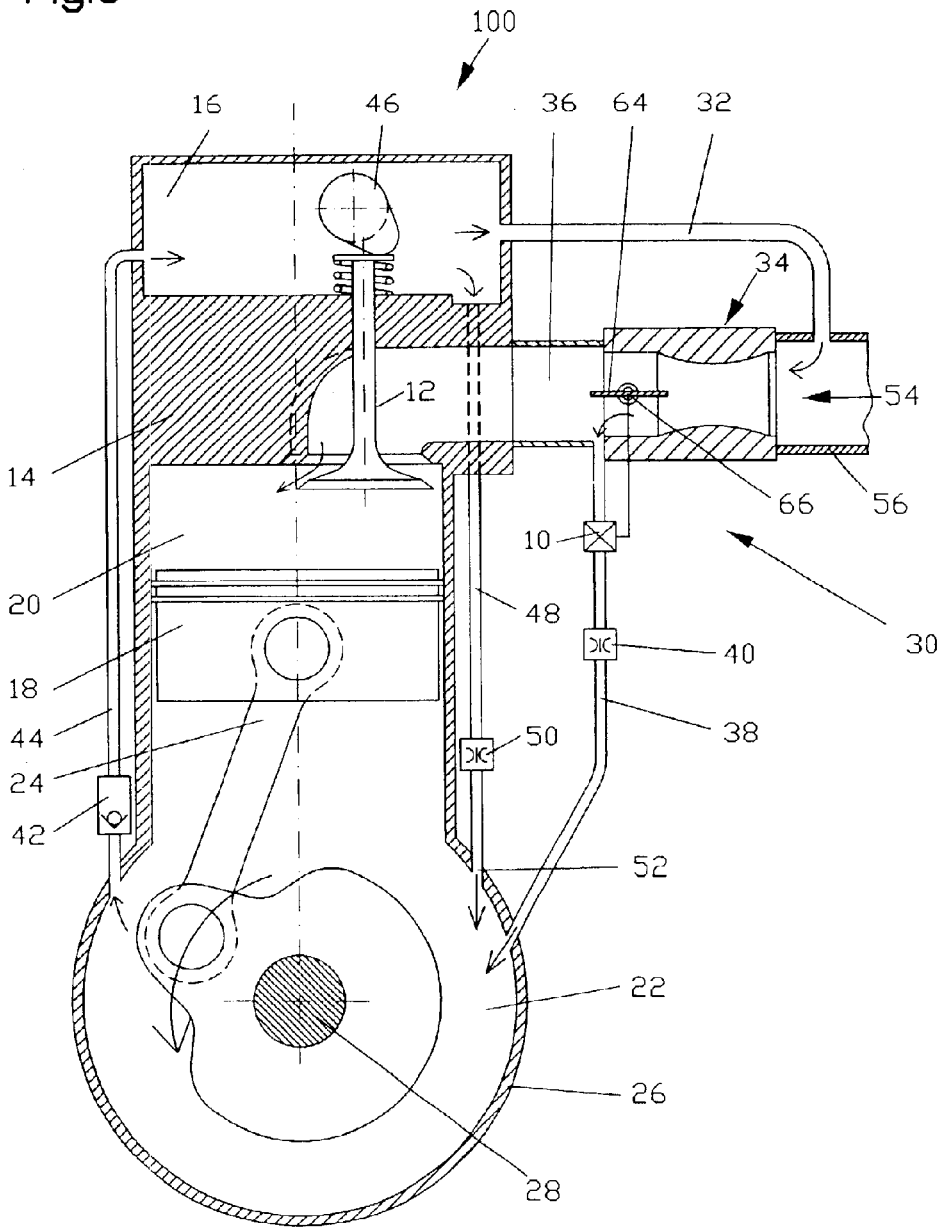

FIG. 1 shows a schematic illustration of a four-stroke internal combustion engine in the intake region with open internal and external lubricant circuits at wide-open throttle, FIG. 2 shows a schematic illustration of a four-stroke internal combustion engine in the intake region with open internal and external lubricant circuits at idle, and FIG. 3 shows a schematic illustration of a four-stroke internal combustion engine in the intake region with open internal and external lubricant circuits and a changed cross-section of the overflow channel at wide-open throttle.

FIG. 1 shows the construction of the intake region of a mixture-lubricated four-stroke internal combustion engine 100. The four-stroke internal combustion engine 100 according to the present invention includes a cylinder 14, in which a reciprocating piston 18 is guided. The reciprocating piston 18 is connected via a connecting rod 24 to a crankshaft 28, which carries a crank disk. A mixture supply line 38, in which an activatable switching valve 10 for switching off idling and a throttle 40 are positioned, discharges into a crankcase 26, which forms the crankshaft chamber 22. The crankshaft chamber 22 is connected to the control chamber 16 via an overflow channel 44. A non-return valve 42 is positioned in the overflow channel 44. The overflow channel is positioned in the crankshaft chamber 22 in such a way that the reciprocating piston 18 does not close the overflow channel 44 as it moves up and down. A camshaft 46, which controls an intake valve 12 via typical rockers, is positioned in the control chamber 16. Control via tappet push rods is also conceivable in this case. A throttle device 34 is positioned in a carburetor housing 56 from a flow direction 54, coming from a carburetor unit, which the intake valve 12 is positioned in alignment with in a mixture intake port 36. After the throttle device 34, the mixture supply line 38 branches off. The throttle device 34 is a throttle valve 64, whose throttle valve shaft 66 has a transverse hole 58 on one side (not shown). A supply opening 60 and an exhaust opening 62, which are not shown, are positioned in the carburetor housing 56 in the region of the throttle valve shaft 66. The throttle device 34 and the mixture intake port 36, as well as the intake valve 12 and the mixture supply line 38, form the supply device 30. Between the control chamber 16 and the mixture intake port 36 positioned after the carburetor, but before the throttle device 34, a connection line 32 engages in the mixture intake port 36. There is the possibility of positioning a control valve 68 in the connection line 32. However, if the cross-section of the connection line 32 is laid out in such a way that the cross-sections of the overflow channel 42 and the mixture intake port are sufficiently large in comparison to the connection line 32, the control valve 68 may be dispensed with. Therefore, the control valve 68 is not shown in FIG. 1 and the following FIGS. 2 and 3.

According to the present invention, the control chamber 16 is also connected to the crankshaft chamber 22 via a return line 48. In this case, an opening 52 is implemented in the crankcase 26, which may not be closed by the movement of the reciprocating piston 18 during its strokes. Furthermore, a throttle 50 is positioned in the return line 48. In addition, one non-return valve 40*a*, 50*a* (FIG. 2) each may be provided in the mixture supply line 38 and/or in the return line 48, which may be dispensed with if there is a piston controller or if the overflow channel 44*a* is comparatively very large.

The four-stroke internal combustion engine 100 illustrated in FIG. 1 operates as follows. The intake region illustrated shows the four-stroke internal combustion engine 100 in the intake stroke with intake valve 12 open. The reciprocating piston 18 moves toward its bottom dead center. During this movement, the reciprocating piston 18 inducts air-fuel mixture via the intake valve 12 when throttle valve 64 of the supply device 30 is completely open. In this way, the air-fuel mixture, which is compressed by the reciprocating piston 18 on its side facing the crankshaft 28, is simultaneously pressed into the control chamber 16 via the non-return valve 42 and the overflow channel 44. Through the arrangement of the return line 48 having the throttle 50 and the non-return valve 50*a*, the overflow channel 44 forms an internal circuit with the return line 48, through which, according to the present invention, additional lubricant is returned from the control chamber 16 into the crankshaft chamber 22. As soon as the intake stroke has ended, the intake valve 12 closes.

During the compression stroke—no longer visible in FIG. 1—the air-fuel mixture is compressed on the top side of the reciprocating piston 18, while the reciprocating piston 18, during its upward movement, simultaneously inducts air-fuel mixture into the crankshaft chamber 22 via the mixture supply line 38 and its non-return valve 40*a* and the throttle valve 64, which is completely open in wide-open throttle operation.

Subsequently, the reciprocating piston 18 moves, after the air-fuel mixture has been ignited in the region of its upper dead center, back in the direction toward its bottom dead center. During this working stroke, which is also not shown in FIG. 1, the air-fuel mixture inducted into the crankshaft chamber 22 during the preceding stroke is compressed and pressed into the control chamber 16 via the overflow channel 44 and the non-return valve 42.

The induction preferably occurs in the direction of the bottom side of the piston 18 in order to cause more rapid heating of the air-fuel mixture and therefore vaporization of the air-fuel mixture and thus reduce the time for the cold-running phase of the engine.

The upward movement occurring in the fourth stroke leads to ejection of the combusted air-fuel mixture via an exhaust valve 10 (not shown), while air-fuel mixture is inducted again via the mixture supply line 38 and the return valve 40 below the reciprocating piston 18.

In the wide-open throttle range, good lubrication is always provided via the existing external circuit through the four-stroke cycle described and the supply of sufficient air-fuel mixture. In addition, the internal circuit—crankshaft chamber 22→overflow channel 44→control chamber 16→return line 48—has a positive effect on the lubrication in the cylinder 14. Through the positioning of the ventilation outlet on the control chamber 16 of the connection line 32 to ventilate the cylinder 14, it is ensured that a sufficient component of air-fuel mixture remains in the cylinder 14. For this case, FIG. 1 shows the connection line 32 next to the driven wheel of the camshaft 46. Carbureted air-fuel mixture and the excess part of the lubricant may be resupplied to the cylinder 14 via the mixture intake port 36. The supply occurs between the carburetor and the supply device 30.

In order to avoid the formation of puddles of lubricant in different operating positions in the control chamber 16, the return line 48 may include multiple return lines; in this case, an arrangement is selected which is assigned to the corresponding operating positions.

However, according to the present invention, the mixture supply line 38 remains blocked during idling operation. The throttle valve 64 is almost completely closed during idling. This measure is performed to ensure stable idling.

The overall conception of the lubricant circuit in the four-stroke internal combustion engine also leads to a further advantageous embodiment, as it may be provided in the construction of the four-stroke internal combustion engine illustrated in FIG. 1 that the fuel pump (not shown in greater detail in the drawing) is driven by the pulse line 69. The excess pressure and partial vacuum arising in the crankshaft chamber 22 during operation are advantageously usable for direct drive of the fuel pump, while the pressure ratios arising in the control chamber 16 are unsuitable or are at least not optimally suitable for driving the fuel pump.

The closed setting of the throttle valve 64 is shown in FIG. 2. This setting represents idling operation. In this case, identical reference numbers indicate identical components. The throttle valve 64 may be displaced via the throttle valve shaft 66 and closes the mixture intake port 36 in a setting displaced by approximately 90°. The throttle valve shaft 66 has a transverse hole 58 on one side, which forms a passage in the carburetor housing 56 together with a supply opening 60 and an exhaust opening 62. The transverse hole 58, the supply opening 60, and the exhaust opening 62 are not shown in FIG. 2.

Since the external circuit of the air-fuel mixture supply is interrupted during idling, the lubricant exchange is only ensured via the internal circuit according to the present invention—crankshaft chamber 22→overflow channel 44→control chamber 16→return line 48.

FIG. 3 shows a further implementation of the device according to the present invention. As shown, the non-return valves 40 and 50 may be dispensed with under certain conditions, independently of wide-open throttle or idling operation.

The non-return valve 50*a* of the return line 48 may be dispensed with if the cross-section of the overflow channel 44 is larger than the cross-section of the return line 48.

The non-return valve 40*a* of the mixture supply line 38 may be dispensed with if the cross-section of the overflow channel 44 is larger than the cross-section of the mixture supply line 38. The non-return valve 40*a* may be dispensed with if the supply 38 is controlled by the piston.

FIG. 3 shows the significantly larger cross-section of the overflow channel 44 in comparison to the cross-sections of the mixture supply line 38 and/or the return line 48.

In this case, both non-return valves 40*a* and 50*a* or possibly only one of the non-return valves 40*a* or 50*a* may be dispensed with.

If the non-return valves 40*a* and 50*a* are not dispensed with, throttles may also be used instead of them.

Under the condition of initial filling upon initial operation, a lack of lubricant during idling is not to be feared. According to the present invention, the following advantages result in summary. During idling, a lack of lubricant is reliably prevented by the internal circuit. Outstanding idling properties are produced, most of the non-return valves able to be dispensed with upon suitable selection of the cross-sections, through which simplified construction and therefore savings in regard to material and assembly costs may be achieved.

List of Reference Numbers

100 four-stroke internal combustion engine
10 switching valve
12 intake valve
14 cylinder
16 control chamber
18 reciprocating piston
20 combustion chamber
22 crankshaft chamber
24 connecting rod
26 crankcase
28 crankshaft
30 supply device
32 connection line
34 throttle device
36 mixture intake port

38 mixture supply line
40 throttle
40*a* non-return valve
42 non-return valve
44 overflow channel
46 camshaft
48 return line
50 throttle
50*a* non-return valve
52 opening
54 flow direction
56 carburetor housing
58 transverse hole
60 supply opening
62 exhaust opening
64 throttle valve
66 throttle valve shaft
68 control valve
69 pulse line (for driving the fuel pump)

What is claimed is:

1. A four-stroke internal combustion engine (100) having a control chamber (16) and a cylinder (14), provided with at least one intake valve (12) and at least one exhaust valve, which has a crankshaft chamber (22) formed by a crankcase (26), in which a connecting rod (24) connected to the reciprocating piston (18) drives a mounted crankshaft (28), having an ignition device and having a supply device (30) for an air-fuel mixture, which is connected on one side via a connection line (32) to the control chamber (16) and on the other side, in the flow direction (54) of the air-fuel mixture, to the piston chamber (20) via a throttle device (34) positioned in a mixture intake port (36) and via a mixture supply line (38), which is connected via a non-return valve (40*a*) to the crankshaft chamber (22) and having an overflow channel (44) between the crankshaft chamber (22) and control chamber (16), in which a camshaft (46) is positioned for controlling the intake and exhaust valves (10, 12), Characterized in that the mixture supply line (38) conduit may be closed if necessary during idling operation via a mechanically controllable on-off valve (10).

2. The device according to claim 1, characterized in that the control chamber (16) is connected to the crankshaft chamber (22) by a return line (48).

3. The device according to claim 1, characterized in that a non-return valve (42) is positioned in the overflow channel (44).

4. The device according to claim 1 or 2, characterized in that a non-return valve (50*a*) is positioned in the return line (48).

5. The device according to claim 2, characterized in that the return line (48) discharges into the crankshaft chamber (22), without the reciprocating piston (18) closing an opening (52) of the return line (48) in the crankcase (26) during its stroke movements.

6. The device according to claim 2, characterized in that the non-return valve (50*a*) of the return line (48) is dispensed with if the cross-section of the overflow channel (44) is larger than the cross-section of the return line (48).

7. The device according to claim 2, characterized in that multiple return lines (48) may be positioned.

8. The device according to one of claim 1 or 7, characterized in that the overflow channel (44) engages in the crankshaft chamber (22) without the reciprocating piston (18) closing the overflow channel (44) during its stroke movements.

9. The device according to claim 1, characterized in that throttles or the like are provided instead of the non-return valves (40*a*, 50*a*).

10. The device according to claim 1, characterized in that the throttle device (34) is a throttle valve (64) whose shaft has a radial transverse hole (50) on one side.

11. The device according to claim 1, characterized in that the fuel pump, implemented as a membrane pump, is connected to the crankshaft chamber (22) via a line implemented as a pulse line (69).

12. A four-stroke internal combustion engine (100) having a control chamber (16) and a cylinder (14), provided with at least one intake valve (12) and at least one exhaust valve, which has a crankshaft chamber (22) formed by a crankcase (26), in which a connecting rod (24) connected to the reciprocating piston (18) drives a mounted crankshaft (28), having an ignition device and having a supply device (30) for an air-fuel mixture, which is connected on one side via a connection line (32) to the control chamber (16) and on the other side, in the flow direction (54) of the air-fuel mixture, to the piston chamber (20) via a throttle device (34) positioned in a mixture intake port (36) and via a mixture supply line (38), and having an overflow channel (44) between the crankshaft chamber (22) and control chamber (16), in which a camshaft (46) is positioned for controlling the intake and exhaust valves (10, 12);

wherein the mixture supply line (38) conduit may be closed if necessary during idling operation via a mechanically controllable on-off valve (10); and wherein the cross-section of the overflow channel (44) is larger than the cross-section of the mixture supply line (38).

13. A four-stroke internal combustion engine (100) having a control chamber (16) and a cylinder (14), provided with at least one intake valve (12) and at least one exhaust valve, which has a crankshaft chamber (22) formed by a crankcase (26), in which a connecting rod (24) connected to the reciprocating piston (18) drives a mounted crankshaft (28), having an igniftion device and having a supply device (30) for an air-fuel mixture, which is connected on one side via a connection line (32) to the control chamber (16) and on the other side, in the flow direction (54) of the air-fuel mixture, to the piston chamber (20) via a throttle device (34) positioned in a mixture intake port (36) and via a mixture supply line (38) controllably opened and closed by the piston (18), and having an overflow channel (44) between the crankshaft chamber (22) and control chamber (16), in which a camshaft (46) is positioned for controlling the intake and exhaust valves (10, 12); and wherein the mixture supply line (38) conduit may be closed if necessary during idling operation via a mechanically controllable on-off valve (10).

* * * * *